US009758888B2

(12) United States Patent
Freydina et al.

(10) Patent No.: US 9,758,888 B2
(45) Date of Patent: Sep. 12, 2017

(54) PREPARATION OF METAL SUBSTRATE SURFACES FOR ELECTROPLATING IN IONIC LIQUIDS

(71) Applicant: XTALIC CORPORATION, Marlborough, MA (US)

(72) Inventors: Evgeniya Freydina, Acton, MA (US); Shiyun Ruan, Arlington, MA (US); Christopher A. Schuh, Wayland, MA (US); Alan C. Lund, Ashland, MA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/271,371

(22) Filed: May 6, 2014

(65) Prior Publication Data

US 2015/0322582 A1 Nov. 12, 2015

(51) Int. Cl.
*C25D 5/44* (2006.01)
*C25D 3/66* (2006.01)
(Continued)

(52) U.S. Cl.
CPC ..... *C25D 3/665* (2013.01); *C25D 5/18* (2013.01); *C25D 5/44* (2013.01); *C25D 5/48* (2013.01);
(Continued)

(58) Field of Classification Search
CPC .. C25D 3/44; C25D 5/18; C25D 3/665; Y10T 428/12764
(Continued)

(56) References Cited

U.S. PATENT DOCUMENTS 4,131,518 A * 12/1978 Fromson ..... 205/324
6,402,931 B1 * 6/2002 Zhou ..... B23H 3/02 204/DIG. 9
(Continued)

FOREIGN PATENT DOCUMENTS

DE 102009046732 A1 * 5/2011 ..... C25D 11/04

OTHER PUBLICATIONS

Liu et al. "Electroplating of mild steel by aluminium in a first generation ionic liquid: A green alternative to commercial Al-plating in organic solvents" vol. 201, Issues 3-4, Oct. 5, 2006, pp. 1352-1356.*
(Continued)

*Primary Examiner* — Brian W Cohen
(74) *Attorney, Agent, or Firm* — Downey Brand LLP

(57) ABSTRACT

Metal surface pretreatments using ionic liquids prior to electroplating are disclosed. The surface treatments include forming an activated metal substrate surface by removing any naturally formed metal oxide layers formed on the surfaces of the metal substrates. According to some embodiments, the surface treatments include exposing the metal substrate to a non-aqueous ionic liquid. In some embodiments, an electrical current is applied to the metal substrate to assist removal of the metal oxide layer. The electrical current can be a pulsed anodic current. After activating the surface, a metal layer can be deposited on the activated surface. In some embodiments, the metal layer is electrodeposited in the same ionic liquid used to form the activated surface. The resultant metal coating is resistant to scratching and peeling.

17 Claims, 9 Drawing Sheets

(51) Int. Cl.

| | |
|---|---|
| ***C25D 5/18*** | (2006.01) |
| ***C25D 5/48*** | (2006.01) |
| ***C25D 11/04*** | (2006.01) |
| ***C25F 1/04*** | (2006.01) |
| ***C25F 1/12*** | (2006.01) |

(52) U.S. Cl.
CPC ..... *C25D 11/04* (2013.01); *C25F 1/04* (2013.01); *C25F 1/12* (2013.01); *Y10T 428/1259* (2015.01); *Y10T 428/12764* (2015.01)

(58) Field of Classification Search
USPC ..... 205/103, 104, 176, 237, 233, 213, 214; 428/610
See application file for complete search history.

(56) References Cited

U.S. PATENT DOCUMENTS

| | | | | |
|---|---|---|---|---|
| 8,733,422 | B2 | 5/2014 | Browning et al. | |
| 2011/0083967 | A1 | 4/2011 | Ruan et al. | |
| 2012/0006688 | A1 | 1/2012 | Alemany et al. | |
| 2012/0031766 | A1 | 2/2012 | Inoue et al. | |
| 2012/0052324 | A1 | 3/2012 | Inoue et al. | |
| 2013/0008796 | A1* | 1/2013 | Silverman | C25D 7/00 205/50 |
| 2013/0075271 | A1* | 3/2013 | Yu | C25D 3/665 205/210 |
| 2013/0168258 | A1* | 7/2013 | Nakano | C25D 3/44 205/261 |
| 2013/0248219 | A1 | 9/2013 | Browning et al. | |
| 2014/0178710 | A1* | 6/2014 | Chen et al. | 428/610 |

OTHER PUBLICATIONS http://mg.tripod.com/asm_prop.htm.*
Machine translation of DE 102009046732 A1, published May 19, 2011.*
Cai, et al. "Tuning nanoscale grain size distribution in multilayered Al—Mn alloys." Scripta Materialia 66, 194-197 (2012).
Lecoeur, et al. "Al current collectors for Li-ion batteries made via a template-free electrodeposition process in ionic liquids." J. Electrochem. Soc. 157, 6 A641-A646 (2010).
Matsui, et al. "Fabrication of bulk nanocrystalline A1 electrodeposited from a dimethylsulfone bath." Mat. Sci. & Engr. A 550, 363-366 (2012).
Ruan, et al. "Electrodeposited A1-Mn alloys with microcrystalline, nanocrystalline, amorphous and nano-quasicrystalline structures." Acta Materialia 57, 3810-3822 (2009).
Ruan, et al. "Towards electroformed nanostructured aluminum alloys with high strength and ductility." J. Mater. Res (2012).

* cited by examiner

PREPARATION OF METAL SUBSTRATE SURFACES FOR ELECTROPLATING IN IONIC LIQUIDS

FIELD

This disclosure relates generally to electroplating methods. In particular, methods for preparing metal substrates prior to electroplating in order to provide a well-adhered electroplated metal layer are described.

BACKGROUND

Metals such as aluminum can readily form a tenacious passivation layer when exposed to ambient conditions. In particular, aluminum forms a thin surface layer of aluminum oxide when exposed to oxygen from the air or water. In some applications, a layer of aluminum oxide is desirable because it can serve as a protective coating for the aluminum surface. In some applications, the natural oxide layer is increased in thickness using an anodizing process to enhance the durability and corrosion resistance of an aluminum part.

However, an aluminum oxide passivation layer can have some disadvantages. For example, the aluminum oxide layer can prevent good adhesion of a subsequently deposited metal layer. That is, the metal layer does not bond well with the aluminum oxide so the metal layer tends to peel away from or scratch away from the surface of the aluminum part. Removing this aluminum oxide layer can be difficult since the surfaces of aluminum can so readily oxidize. Even if the aluminum oxide layer is removed, a new aluminum oxide layer quickly forms back on the surface when exposed to air or an aqueous medium, such as an aqueous electrodeposition medium.

SUMMARY

This paper describes various embodiments that relate to treating metal substrates and electroplating onto metal substrates.

According to one embodiment, a method of depositing metal layer on a surface of a metal substrate is described. The method involves activating the surface of the metal substrate by exposing the metal substrate to an ionic liquid configured to remove a metal oxide layer formed on the metal substrate. The method also involves electrodepositing a metal layer on the activated surface such that a metallic bond is formed between the metal layer and the metal substrate.

According to another embodiment, a metal article is described. The metal article includes an aluminum substrate that includes a first aluminum alloy. The metal article also includes an aluminum layer deposited directly on a surface of the aluminum substrate such that a metallic bond is formed between the aluminum layer and the aluminum substrate. The aluminum layer includes a second aluminum alloy.

According to a further embodiment, a method of providing a coating on a surface of an aluminum substrate is described. The method involves exposing the aluminum substrate to an ionic liquid configured to remove an aluminum oxide layer formed on the aluminum substrate activating the surface of the aluminum substrate. The method also involves depositing an aluminum layer on the activated surface such that a metallic bond is formed between the aluminum layer and the aluminum substrate.

These and other embodiments will be described in detail below.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
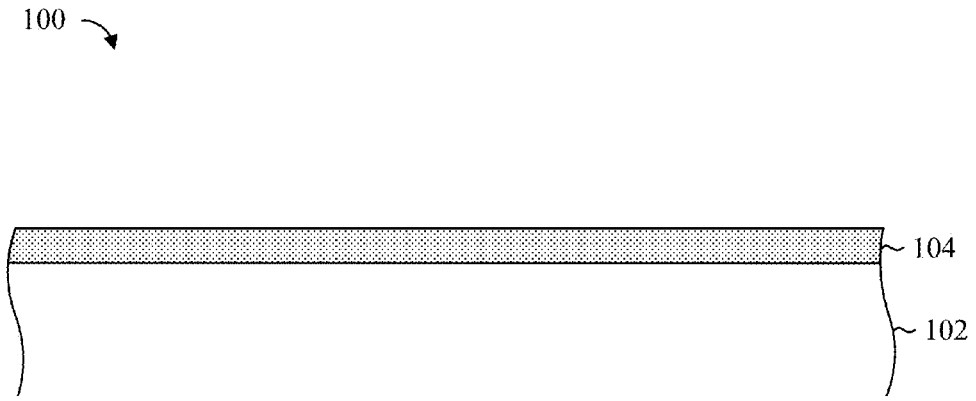
FIGS. 1A-1D show portions of a part undergoing a surface activation and electroplating process in accordance with described embodiments.

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as can be included within the spirit and scope of the described embodiments as defined by the appended claims.

The following disclosure relates to electroplating methods. The methods described can be used to activate a metal substrate prior to electroplating metals, such as aluminum alloys. In some cases the methods involve using a non-aqueous ionic liquid electrolyte and forward-reverse pulses of electric current. In the present disclosure, non-aqueous, ionic liquid electrolyte and forward-reverse pulses can be used to remove surface contaminants from commercial aluminum substrates and activate the aluminum substrate for subsequent deposition of metal from an ionic liquid electrolyte. Conventional methods of surface activation of aluminum substrates are complicated and use an intermediate metal layer such as zinc or tin. In the present disclosure, substantially no intermediate layer is used since the ionic liquid electrolyte used for surface activation can be compatible with the electrolyte that is used for electrodeposition.

As described above, aluminum surfaces readily form a passivation layer that can hinder adhesion of a subsequently plated metal. Thus, the surface of the aluminum substrate should be activated before electroplating of aluminum or other alloys from an ionic liquid. This is because it is difficult to activate the aluminum substrate in an aqueous medium, and then transfer it into an ionic liquid bath. During the drying and transfer process, the aluminum surface quickly oxidizes and re-passivates. Hence, in conventional surface activation approaches the aluminum surface is electroplated with zinc or tin in order to maintain an active surface after removing from the electrolyte.

The present disclosure describes a method of aluminum substrate activation directly in the ionic liquid electrolyte, which eliminates or minimizes surface oxidation before the electroplating process. The aluminum substrate can be immersed into an ionic liquid bath and an anodic pulse (forward pulse) current applied to the substrate so that a top layer of the substrate surface is dissolved into the bath. An anodic pulse can electrolytically assist removal of the passivation layer and/or contaminants. In some embodiments, the anodic pulse current density is between about 50 $mA/cm^2$ and about 400 $mA/cm^2$ and the duration of the pulse varies from about 5 to about 50 milliseconds. A reverse pulse may be applied between the oxidizing pulses. In some embodiment, the current density values can range from zero to substantially the same current density value as the oxidizing pulse. The reverse pulse can be used to deposit some amount of dissolved aluminum back onto the substrate, helping to level the substrate surface. The ionic liquid bath can contain an ionic liquid compatible with the aluminum ion species, a co-solvent and additives that may influence conductivity, viscosity, diffusion of aluminum ions, and surface tension of the bath. The same electrolytic bath may or may not be the same as the bath used for subsequent electroplating.

As used herein, the term "aluminum substrate" can refer to any aluminum-containing structure suitable for depositing a metal layer thereon. For example, the aluminum substrates can include those made of pure aluminum or suitable aluminum alloys. In some embodiments, the aluminum substrate includes one or more of copper, manganese, silicon, magnesium, zinc, nickel, iron and lithium. The term "aluminum layer" can refer to any suitable aluminum-containing material that can be deposited on a metal substrate. The aluminum layers can include those made of pure aluminum or suitable aluminum alloys. In some embodiments, the aluminum layer includes manganese. The term "aluminum oxide" can refer to any suitable aluminum oxide material and is not limited to pure aluminum oxides. For example, the aluminum oxide can include those aluminum oxides formed from aluminum alloys and include other materials or metals other than aluminum, such as manganese.

The methods described herein are well suited for providing both protective and attractive surfaces to visible portions of consumer products. For example, methods described herein can be used to provide protective and cosmetically appealing exterior portions of metal enclosures and casings for electronic devices, such as those manufactured by Apple Inc., based in Cupertino, Calif. In particular embodiments, the methods are used to form protective coatings for exterior metallic surfaces of computers, portable electronic devices and/or accessories for electronic devices.

These and other embodiments are discussed below with reference to FIGS. 1-6. However, those skilled in the art will readily appreciate that the detailed description given herein with respect to these Figures is for explanatory purposes only and should not be construed as limiting.

FIGS. 1A-1D show portions of part 100 undergoing a surface activation and electroplating process in accordance with described embodiments. FIG. 1A shows a cross section view of a portion of part 100 that includes metal substrate 102. Metal substrate has metal oxide layer 104 formed thereon that can be, for example, a naturally formed metal oxide formed during passive exposure to air and/or water. Part 100 can be any suitable part and have any suitable shape. In some embodiments, part 100 is a consumer product or a portion of a consumer product. For example, part 100 can be an enclosure for an electronic device or a portion of an enclosure for an electronic device. Metal substrate 102 can be made of any suitable metal. In some embodiments, metal substrate 102 includes one or more of aluminum, chromium, tungsten, molybdenum, zirconium and nickel. Methods described herein are well suited for metals that tend to easily form a persistent metal oxide layer such as aluminum-containing, titanium-containing and/or magnesium-containing materials. In particular embodiments, metal substrate 102 is made of aluminum or an aluminum alloy. Some suitable aluminum alloys can include 1000, 2000, 6000 and 7000 series aluminum alloys. In particular embodiment, metal substrate 102 is made a 1000 series aluminum alloy. In a different embodiment, metal substrate 102 is made of a 6063 series aluminum alloy. The surface of metal substrate 102 can have any suitable shape or characteristic. For example, metal substrate 102 can have a substantially flat or curved surface or can have a textured (e.g., etched or blasted) surface. In some embodiments, the surface of metal substrate 102 is polished to mirror-like shine. Metal substrate 102 can be in the form of a thin metal foil or a larger bulk metal piece.

As described above, some metals, such as aluminum and aluminum alloys tend to quickly form a thin and persistent natural metal oxide layer 104 when exposed to air and/or water. Metal oxide layer 104 can prevent good adhesion of a subsequently deposited coating, such as a subsequently deposited metal layer. This is because metal oxide layer 104 generally does not adhere well to the deposited metal layer. That is, the metal layer will tend to peel away from or become detached from metal oxide layer 104. It can be difficult to remove metal oxide layer 104 from metal substrate 102 prior to depositing a metal layer because of the tendency of substrate 102 re-oxidizing. For example, if an electrodeposition technique is used to electrodeposit the metal layer, metal oxide layer 104 can form when exposed to an aqueous electrodeposition electrolytic bath. In addition, when metal substrate 102 is exposed to air during transfer to/from the electrodeposition bath, metal substrate 102 can re-oxidize forming another metal oxide layer.

A well-known technique for providing a better adhering electrodeposited metal layer involves forming one or more intermediate metal layers between metal substrate 102 and the metal layer. For example, a thin layer of zinc or tin and/or an additional layer of copper can be deposited onto substrate 102. This intermediate metal layer(s) adheres well to the metal substrate 102 and the subsequently deposited metal layer. However, these intermediate metal layers can have some drawbacks. For example, the intermediate metal layer (s) can affect the cosmetic quality of the deposited metal layer. In addition, the intermediate metal layers may adversely affect a subsequent anodizing process. Methods described involve avoiding the use of an intermediate metal layer between metal substrate 102 and a deposited metal layer. Instead, the methods described herein involve removing metal oxide layer 104 and forming an activated metal surface that can directly bond with the subsequently deposited metal layer.

Figure 1B:
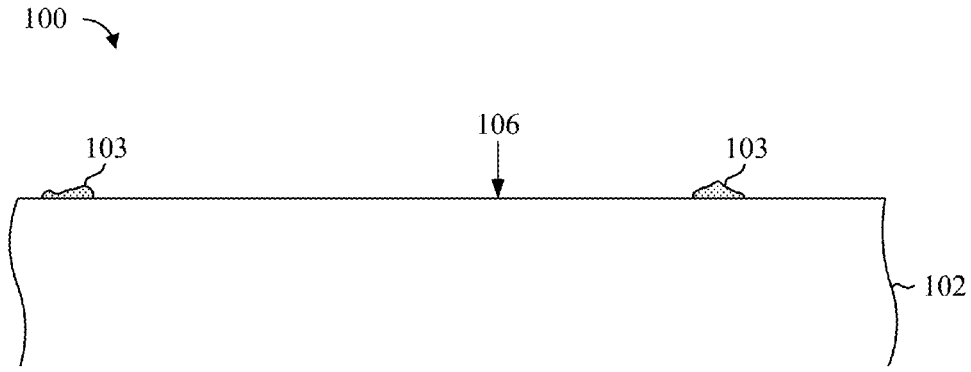

FIG. 1B shows a cross section view of a portion of part 100 after a surface activation process in accordance with described embodiments. As shown, metal oxide layer 104 is removed from metal substrate 102 forming activated surface 106. Removing metal oxide layer 104 can involve exposing metal substrate 102 to an ionic liquid. The ionic liquid dissolves metal oxide layer 104, and in some cases, a portion of metal from metal substrate 102. Activated surface 106 includes a fresh metal surface that is available for direct metallic bonding with a subsequently deposited metal. In some embodiments, there can be some small amount of metal oxide material 103 from metal oxide layer 104 remaining on surface 106 after ionic liquid exposure. For example, metal oxide material 103 may be in the form of randomly distributed small islands on surface 106 that aren't completely removed by the ionic liquid.

If metal substrate 102 is easily oxidized, activated surface can be very susceptible re-oxidizing if exposed to any oxygen-containing oxidizing agent. Thus, in some embodiments, the ionic liquid is non-aqueous in that it contains substantially no water or other oxidative forms of oxygen. This way, the ionic liquid can provide activated surface 106 an environment safe from re-oxidizing. In some embodiments, an electrical current is applied to metal substrate 102 while exposed to the ionic liquid to assist removal of metal oxide layer 104. Details of forming activated surface 106 using an ionic liquid in accordance with some embodiments are described below with reference to FIG. 2A.

Figure 1C:
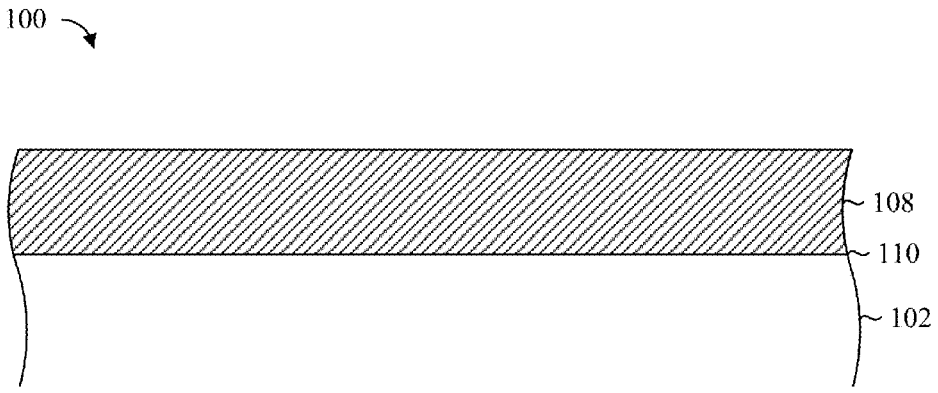

After activated surface 106 is formed, part 100 is ready for a metal deposition process. FIG. 1C shows a cross section view of a portion of part 100 after a metal deposition process in accordance with described embodiments. Metal layer 108 is deposited directly on activated surface 106 forming a metallic bond 110 between metal layer 108 and metal substrate 102. Metal layer 108 can include any suitable metal. In some embodiments, metal layer 108 is deposited such that metal layer 108 is continuous and consistent; that is, metal layer 108 is not agglomerated and does not substantially include gaps. In some embodiments, metal layer 108 includes an anodizable material, such as aluminum, titanium, zinc, magnesium, niobium, zirconium, hathium, tantalum or combinations thereof. In particular embodiments, metal layer 108 is made of aluminum or an aluminum alloy. In some embodiments, metal layer 108 is made of a different type of metal than metal substrate 102. For example, metal layer 108 can be made of a harder material than metal substrate 102 to provide a hard coating for metal substrate 102. In some cases, metal layer 108 is chosen for its improved cosmetic quality compared to metal substrate 102. In other embodiments, metal layer 108 and metal substrate 102 are made of substantially the same metal material.

Metals layer 108 can be characterized as having any of a number of suitable microstructures. For example, metal layer 108 can include different types of crystalline phases (such as face-centered cubic, body-centered cubic, hexagonal close-packed, or specific ordered intermetallic structures), as well as amorphous, quasi-crystalline and dual phase structures. In some embodiments, metal layer 108 has polycrystalline microstructure. In some cases the polycrystalline microstructure is nanocrystalline structure; meaning metal layer 108 is characterized as having an average grain size in the nanometer scale. Polycrystalline metal and metal alloys are sometimes characterized using a microstructural length scale, which refers to an average grain size of the polycrystalline metal or metal alloy. In a particular embodiment, metal layer 108 includes a nanocrystalline aluminum alloy material characterized as having a microstructural length scale range from about 15 nm to about 2500 nm. Details as to some suitable nanocrystalline metal and metal alloys in accordance with described embodiments, as well as electrodeposition methods for forming nanocrystalline metal and metal alloys, are described in U.S. Patent Application Publication No. 2011/0083967 A1, hereby incorporated by reference in its entirety.

Metal layer 108 can have any suitable thickness. In some embodiments, metal layer 108 has a thickness suitable for a subsequent anodizing process, whereby at least a portion of metal layer 108 is converted to a metal oxide. In some embodiments, metal layer 108 has a thickness ranging from about 1 micrometer to about 50 micrometers. In other embodiments, metal layer 108 has a thickness greater than about 50 micrometers. Metal layer 108 can be deposited onto metal substrate 102 using any suitable technique, including suitable electrodeposition techniques. Details of electrodepositing metal layer 108 according to some embodiments are described below with reference to FIG. 2B.

Since metallic bond 110 involves metal-to-metal bonding between metal substrate 102 and metal layer 108, metallic bond 110 can be strong enough to resist typical separation forces applied to part 100. For example, metal layer 108 can be resistant to forces such as scratching, peeling or tearing forces. In this way, metal layer 108 can act as a strongly adhered coating to metal substrate 102 and part 100. In some embodiments, metal layer 108 is a coating that provides structural properties, such as hardness or resistance to deformation, to metal substrate 102 and part 100. In other embodiments, metal layer 108 provides cosmetic properties, such as a particular color or optical reflectivity, to metal substrate 102 and part 100. In some embodiments, metal layer 108 provides both structural and cosmetic properties to substrate 102 and part 100. Note that since there is no intermediate layer (e.g., zinc, tin and/or copper), any denting or scratching that does occur at metal layer 108 will not reveal an underlying intermediate layer that can detract from the cosmetic appeal of part 100.

Figure 1D:
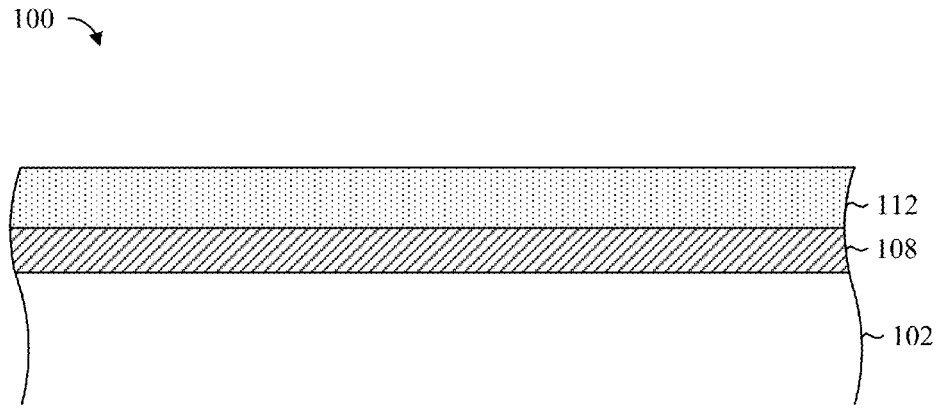

FIG. 1D shows a cross section view of a portion of part 100 after an optional anodizing process in accordance with described embodiments. When metal layer 108 is exposed to an anodizing process, a portion of metal layer 108 is converted to metal oxide layer 112. Metal oxide layer 112 can provide a hard corrosion resistant coating to substrate 102 and part 100. In some cases, metal oxide layer 112 can be dyed to impart a color a surface of part 100. Any suitable type of anodizing process can be used and any suitable amount of metal layer 108 can be converted to metal oxide layer 112. Note that since there is no intermediate layer (e.g., zinc, tin and/or copper), there is no chance of material from such an intermediate layer to adversely affect the anodizing process. Thus, potentially more of metal layer 108 can be converted to metal oxide layer 112. These details and other details with regard suitable anodizing processes in accordance with described embodiments are described below with respect to FIG. 2C.

Figure 2A:
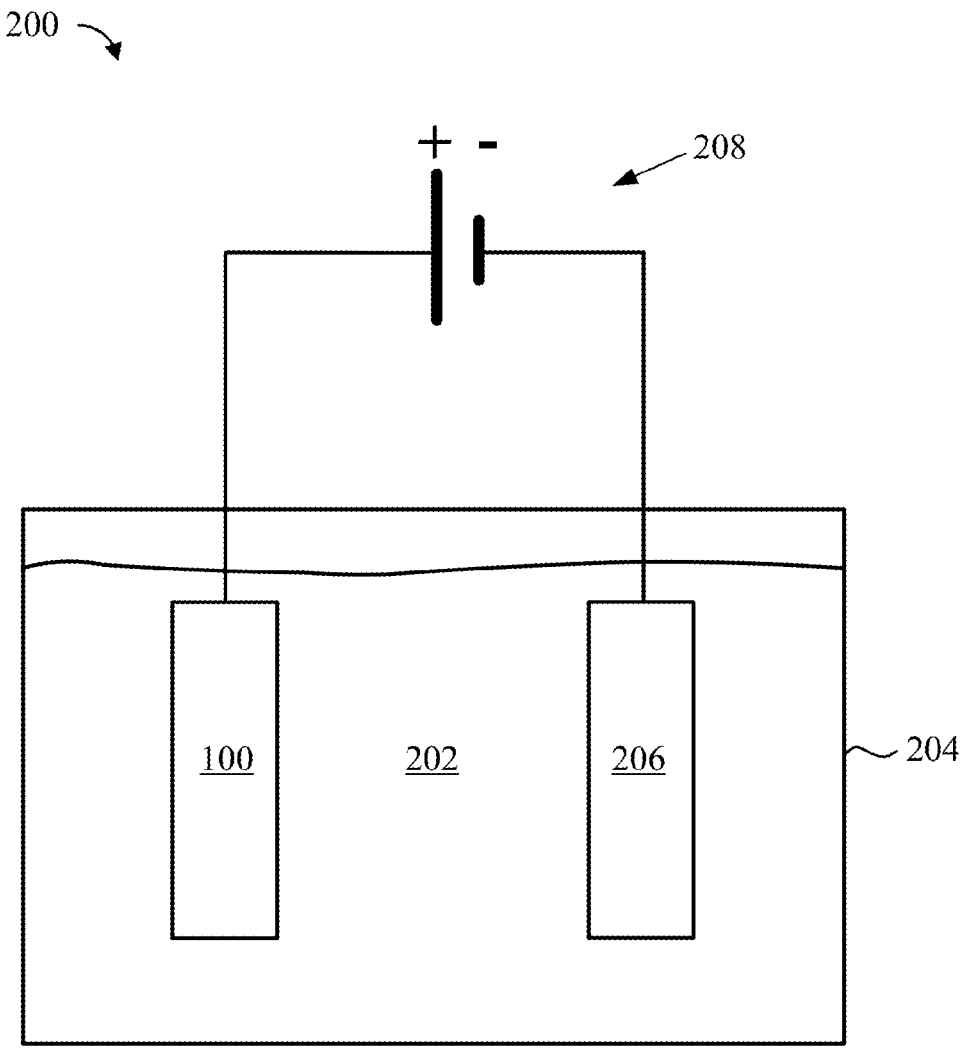
FIGS. 2A-2C show processing apparatuses suitable for processing the part shown in FIGS. 1A-1D in accordance with described embodiments.
Figure 2B:
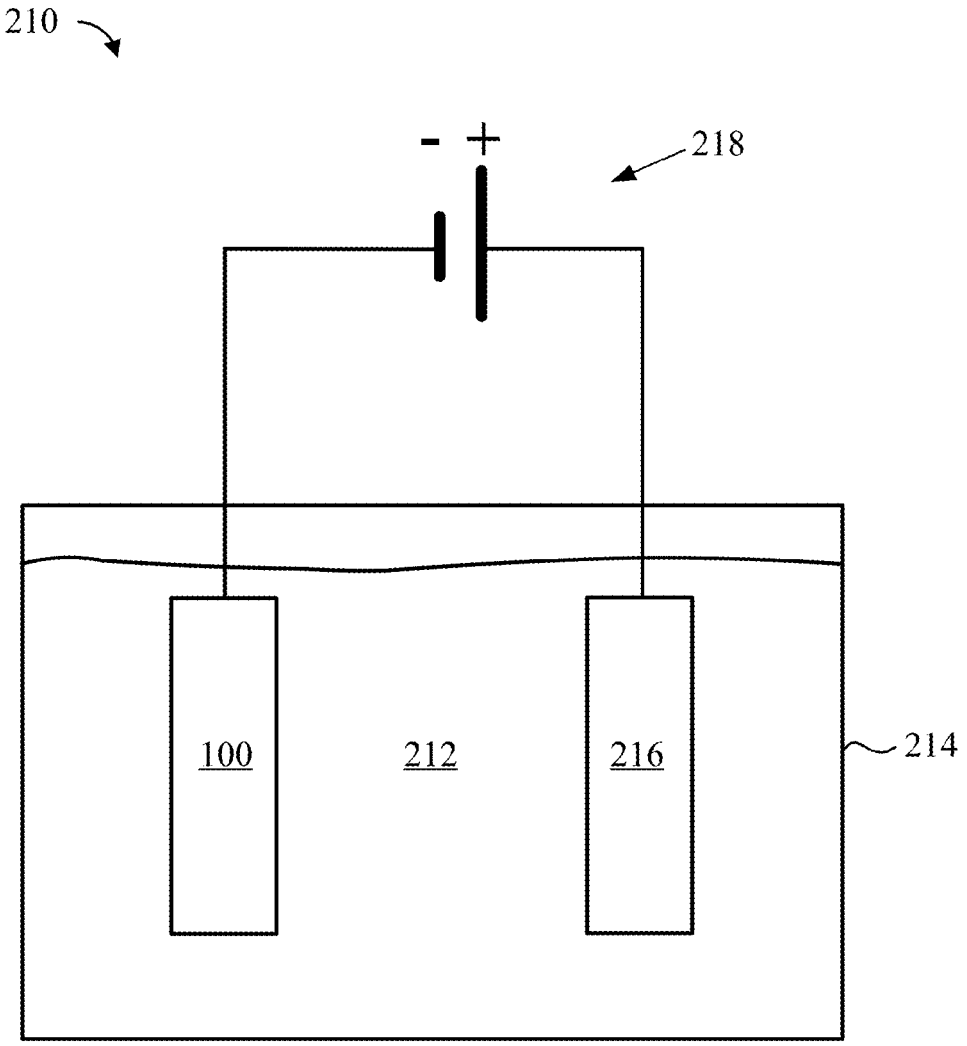
Figure 2C:
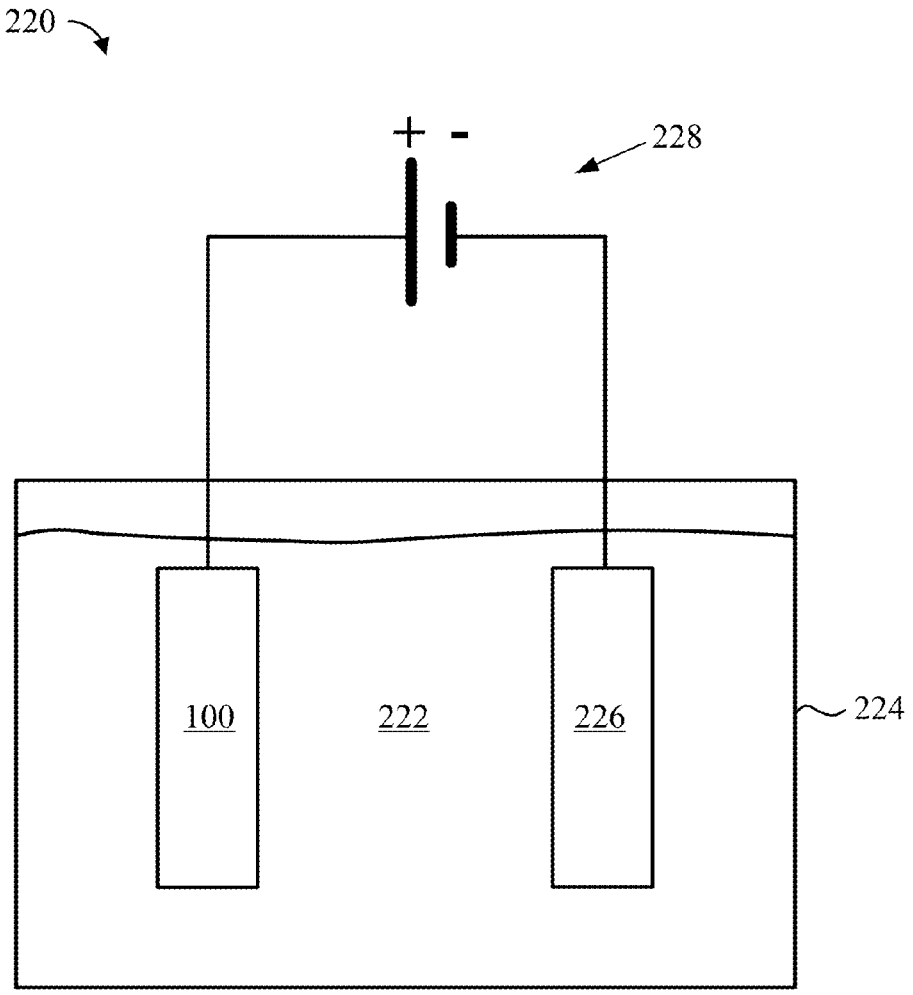

FIGS. 2A-2C show schematic views of apparatuses suitable for processing part 100 as described above with respect to FIGS. 1A-1D. FIG. 2A shows apparatus 200 suitable for forming activated surface 106 on part 100 in accordance with some embodiments. Apparatus 200 includes tank 204 suitable for containing ionic liquid 202. Part 100 is exposed to or immersed in ionic liquid 202. In other embodiments, only a portion of part 100 is exposed in ionic liquid 202. Ionic liquid 202 includes salts of one or more chemical species capable of dissolving metal oxide 104 and/or contaminants from the surface of metal substrate 102, thereby creating a fresh metal surface or activated surface 106. In some cases, a portion of metal substrate 102 is also dissolved in the form of metal ions into ionic liquid 202. Thus, ionic liquid 202 should contain chemical species compatible with any metal ions originating from metal substrate 102. For example, if metal substrate 102 has aluminum, ionic liquid 202 should be compatible with aluminum ions. In some embodiments, ionic liquid 202 contains one or more co-solvents and/or additives that may influence conductivity, viscosity, diffusion of metal ions, and/or surface tension of ionic liquid 202. In particular embodiments, ionic liquid 202 includes 1-ethyl-3-methylimidazolium (EMIM) chloride, $AlCl_3$ and a co-solvent. In some embodiments, the co-solvent includes toluene. In some embodiments, ionic liquid 202 is non-aqueous and substantially free of water. In addition, ionic liquid 202 can be substantially free of other oxidative agents such that activated surface 106 does not become re-oxidized once activated. In this way, ionic liquid 202 can serve as a safe medium for the activated surface 106. The temperature of ionic liquid 202 can vary depending on a number of factors such as the chemical constitution of ionic liquid 202 and the type of metal of metal substrate 102.

In some embodiments, ionic liquid 202 can include materials from part 100 that have been dissolved within ionic liquid 202. For example, if part 100 includes a metal alloy, such as an aluminum alloy, ionic liquid 202 may include alloy-related elements such as one or more of scandium, titanium, vanadium, chromium, manganese, iron, cobalt, nickel, copper, yttrium, zirconium, niobium, molybdenum, technetium, rhodium, ruthenium, silver, cadmium, platinum, palladium, iridium, hafnium, tantalum, tungsten, rhenium, osmium, lithium, magnesium, beryllium, calcium, strontium, barium, radium, zinc, gold, uranium, silicon, gallium, germanium, indium, thallium, tin, antimony, lead, bismuth, mercury, aluminum, selenium, sodium and tellurium.

In some embodiments, an electrical current is applied to metal substrate 102 in order to assist removal of metal oxide layer 104. This can be accomplished by arranging metal substrate 102 as an anode in an electrolytic cell. As shown in FIG. 2A, metal substrate 102 can be electrically coupled to cathode 206 via power supply 208. Power supply 208 applies an anodic current to metal substrate 102 that causes metal from metal substrate 102 to ionize and create a flow of metal ions away from metal substrate 102. This flow of metal ions can assist removal of metal oxide layer 104. Power supply 208 can be configured to apply a direct current and/or an alternating current.

In some embodiments, the anodic current is pulsed to further assist removal of metal oxide layer 104. A pulsed current may allow usage of a larger maximum current compared to using a non-pulsed current (e.g., DC), which can help dissolve metal oxide layer 104 into ionic liquid 202. The current density, duration of each anodic pulse and overall duration of applied anodic current can vary depending on a number of conditions including the size and type of metal substrate 102, as well as the constitution of ionic liquid 202. In particular embodiments, the anodic pulse current ranges from about 50 $mA/cm^2$ and about 400 $mA/cm^2$. In particular embodiments, the average duration of each anodic pulse ranges from about 5 milliseconds and about 50 milliseconds. The overall duration of the anodic current can vary in the order of seconds to minutes. In particular embodiments, the overall duration of the anodic current is around 5 minutes. In some embodiments, a reverse pulse separates each of the anodic pulses. During a reverse pulse, a zero or negative current is applied to metal substrate 102. A negative reverse pulse can be used to deposit some of the metal ion dissolved within ionic liquid 202 back onto metal substrate 102 between anodic pulses. This can have the effect of leveling out any roughness on the metal substrate 102 created by the forward pulses. In some embodiments, the reverse pulse ranges from about 0 $mA/cm^2$ to about the same amplitude of current density of the anodic (forward) pulse (i.e., −50 $mA/cm^2$ to about −400 $mA/cm^2$).

After activated surface 106 is formed, metal layer 108 can be deposited onto activated surface 106 using any suitable technique. In some embodiments, metal layer 108 is deposited using an electrodeposition technique. FIG. 2B shows electrodeposition apparatus 210 suitable for depositing metal layer 108 on activated surface 106 in accordance with some embodiments. Apparatus 210 includes ionic liquid 212 contained in tank 214. In some embodiments, ionic liquid 212 is the same as ionic liquid 202 used in forming activated surface 106. That is, apparatus 200 used for forming activated surface 106 can be the same as apparatus 210 used for electrodeposition. This can be accomplished, for example, using a rectifier that switches power supply 208/218 from an oxide removal configuration to a plating configuration. Keeping part 100 in the same ionic liquid for both activation and deposition can prevent metal substrate 102 from having to be transferred from station to station and allowing opportunities for re-oxidation of activated surface 106. In other embodiments, apparatus 210 used for electrodeposition is different from apparatus 200 used for forming activated surface 106. That is, there may be situations for using different ionic liquids for the oxide removal and the plating processes. For example, ionic liquid 202 can be customized to optimize oxide removal while ionic liquid 212 can have a different chemical constitution that is optimized for a plating process. In these embodiments, part 100 can be transferred from apparatus 200 to apparatus 210 in an inert environment, such as a nitrogen or argon environment, to prevent re-oxidation of activated surface 106. In some embodiments, the current is applied to part 100 prior to immersion into ionic liquid 212 to start the plating process prior to other chemical reactions that can occur in ionic liquid 212 (sometimes referred to as "going in live"). This technique may be valuable in cases where ionic liquid 212 is aqueous and could potentially re-oxide activated surface 106 prior to plating.

In electrodeposition apparatus 210, plating occurs at part 100 and oxidation occurs at anode 216. Power supply 218 supplies a current to anode 216 causing metal ions within ionic liquid 212 to flow toward and deposit as metal onto activated surface 106 of metal substrate 102 forming metal layer 108 on metal substrate 102. Power supply 218 can be configured to supply a continuous or pulsed current. In some embodiments, the deposited metal includes aluminum. In some embodiments, aluminum is co-deposited with one or more metals forming an aluminum alloy layer on metal substrate 102. In particular embodiments, aluminum is co-deposited with manganese forming an aluminum-manganese alloy metal layer 108. In one embodiment, ionic liquid 212 includes an $[EMIM]^+/Al_2Cl_7^-$ ionic liquid with a co-solvent and manganese chloride. If the same ionic liquid is used for forming activated surface 106 and forming metal layer 108, the non-aqueous liquid should be compatible with the metal ion species dissolved therein during formation of activated surface 106. Ionic liquid 212 can contain any of a number of suitable co-solvents and additives that can influence conductivity, viscosity, diffusion of metal ions and surface tension. Metal layer 108 can be deposited to any suitable thickness.

After metal layer 108 is formed, metal substrate 102 can optionally be exposed to an anodizing process. FIG. 2C shows anodizing apparatus 220 suitable for anodizing part 100 in accordance with some embodiments. In general, anodizing is an electrolytic passivation process that involves exposed anodizable metal surfaces of part 100. Anodizing apparatus 220 includes power supply 228 that electrically couples part 100 with cathode 226, which are positioned within anodizing bath 222 contained in tank 224. Prior to anodizing, the surface of part 100 can be cleaned (e.g., degreased) using one or more suitable pre-anodizing cleaning processes. In some embodiments, metal layer 108 undergoes one or more surface texturing processes prior to anodizing, such as one or more of a polishing, etching or blasting process. During anodizing, at least a portion of metal layer 108 is converted to metal oxide layer 112. Any suitable anodizing conditions and process parameters can be used. Anodizing parameters such as chemical constitution of electrolyte 222, type and amount of current and anodizing duration can vary depending on a number of factors including the type of metal of metal layer 108 and desired thickness and quality of metal oxide layer 112. As described above, since there is no intermediate layer (e.g., zinc, tin and/or copper) between metal substrate 102 and metal layer 108, there is no chance of material from such an intermediate layer to enter anodizing bath 222. For example, in some cases the presence of copper in anodizing bath 222 can short out and ruin the anodizing process. This means that potentially more of metal layer 108 can be converted to metal oxide layer 112 without fear of reaching an intermediate metal layer. In some embodiments, substantially all of metal layer 108 is converted to metal oxide layer 112.

EXAMPLE 1

Aluminum foil (1000 series alloy) was used as a substrate in [EMIM].$Al_2Cl_7$ ionic liquid with a co-solvent, containing manganese chloride. The substrate was activated by: anodic pulse of 240 mA/cm$^2$ for 20 milliseconds, followed by reverse pulse of 120 mA/cm$^2$ for 20 milliseconds. The activation current was applied for 5 min. After activation, the substrate was electroplated with aluminum-manganese alloy from the same bath.

EXAMPLE 2

Aluminum substrate (6063 series alloy) was activated in [EMIM].$Al_2Cl_7$ ionic liquid with a co-solvent. Anodic pulse current was applied for 5 minutes: 100 mA/cm$^2$, 20 milliseconds pulses with 20 milliseconds intervals between the pulses. The substrate was removed from the activating bath and placed in the electroplating bath, all in an inert atmosphere. The electroplating bath contained [EMIM].$Al_2Cl_7$ ionic liquid with a co-solvent, and manganese chloride. After electroplating, the sample was tested for adherence.

Figure 3A:
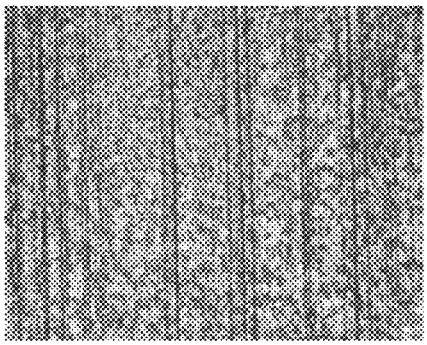
FIGS. 3A-3C shows images of top views of an aluminum coated substrate prepared using described embodiments undergoing a tape and peel test.
Figure 3B:
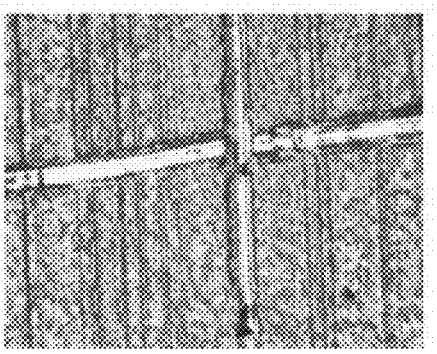
Figure 3C:
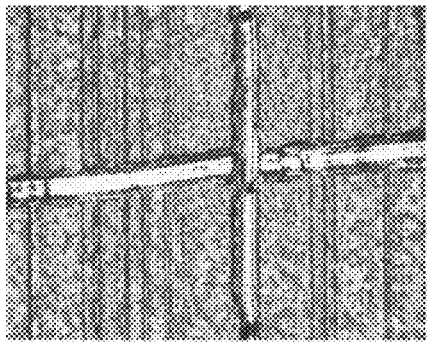

FIGS. 3A-3C shows images of top views of an aluminum coated substrate sample (6063 aluminum substrate) prepared using the process conditions of Example 2. The adherence of the aluminum coating was demonstrated using a tape and peel testing process. The tape and peel testing involved scratching the coating to a depth exceeding the thickness of the coating and then applying and peeling off a pressure sensitive adhesive tape. In some embodiments, testing was conducted under the provisions of ASTM D3359-09 Standard Test Methods for Measuring Adhesion by Tape Test. Coatings that are adhered well will remain on the substrate after the peeling off of the adhesive tape. FIG. 3A shows the substrate sample after undergoing a surface activation and aluminum deposition using methods described above. FIG. 3B shows the same substrate sample after undergoing a scratch procedure where the sample was scratched to a depth exceeding the thickness of the coating. That is, the plated aluminum coating was scratched to a depth such that the underlying substrate was exposed. FIG. 3C shows the same sample after an adhesive tape was applied, pressed and peeled off the scratched surface. The sample was examined for any signs of the coating detachment from the substrate.

As shown by FIGS. 3B and 3C, the entire aluminum coating remained affixed to the substrate after the adhesive tape was peeled off. This result shows that forming an activated substrate surface by removal of a top surface of the metal substrate using methods disclosed prior to electroplating provides for a well-adhered metal layer. That is, the coatings can fulfill their function of protecting and/or decorating a part for an expected service life of the part. For example, the coatings are well suited for coating metal surfaces of consumer products like exterior surface of handheld and other electronic devices that are often subject to forces that can peel a coating from a substrate.

Other suitable methods for testing the adhesion of a metal layer can include ASTM D6677-07 Standard Test Method for Evaluating Adhesion by Knife and ASTM B571-97 Standard Practice for Qualitative Adhesion Testing of Metallic Coatings.

Figure 4:
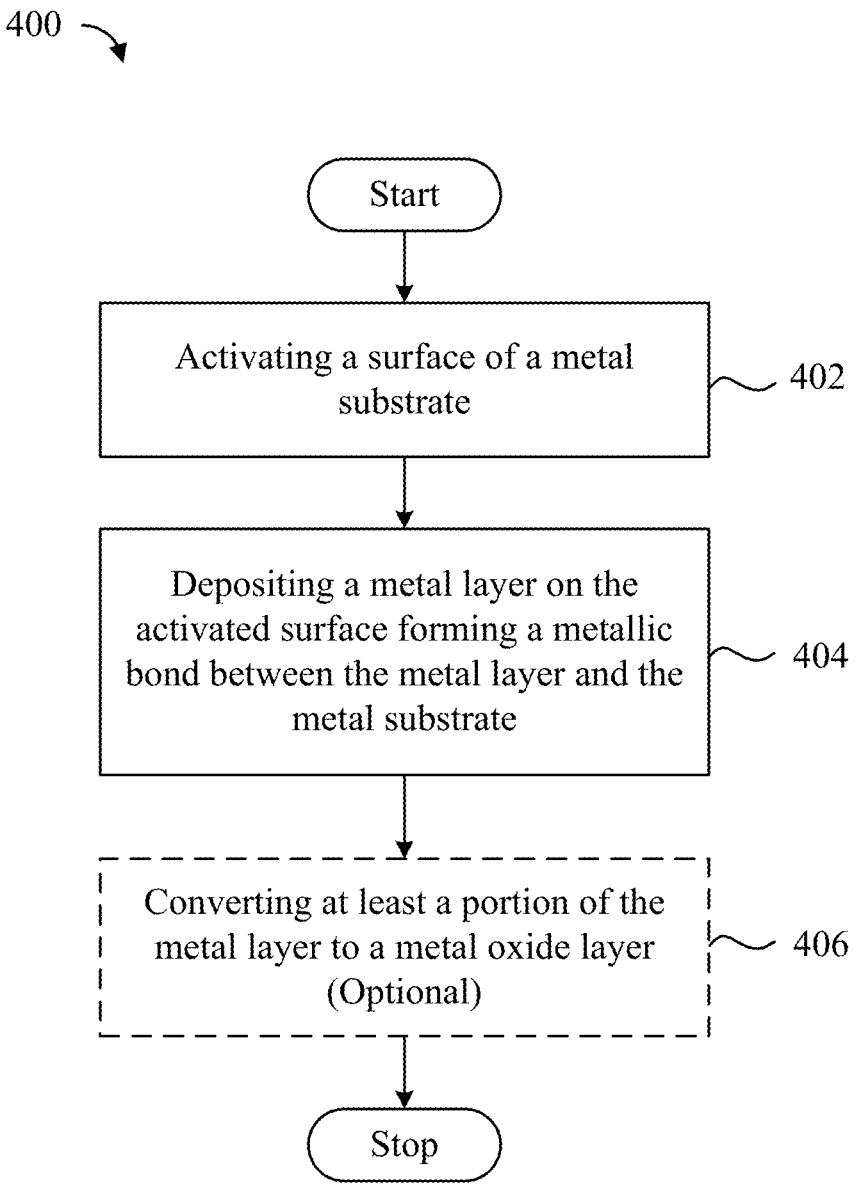
FIG. 4 shows a high-level flowchart indicating a substrate surface activation and electroplating process in accordance with described embodiments.

FIG. 4 shows high-level flowchart 400 indicating a metal substrate activation and electroplating process in accordance with described embodiments. At 402 a surface of a metal substrate is activated. Activation can include removing a metal oxide, such as a naturally formed metal oxide layer on surfaces of the metal substrate from exposure to air and/or water. The metal substrate can include any suitable metal. In some embodiments, the metal substrate includes aluminum metal, such as an aluminum alloy. Removing the metal oxide can include exposing the metal substrate to an ionic liquid containing one or more chemical agents capable of dissolving the metal oxide. In some embodiments, a small amount of metal oxide material from metal oxide layer remains on the surface of the metal substrate after ionic liquid exposure. In some embodiments, the ionic liquid dissolves substantially the entire metal oxide layer. In some embodiments, the ionic liquid can also dissolve a portion of the metal substrate. In some embodiments, the ionic liquid is substantially free of any oxidizing agent that can re-oxidize the metal substrate. For example, the ionic liquid can be a non-aqueous ionic liquid.

In some embodiments, an anodic current is applied to the metal substrate to assist surface activation and removal of any metal oxide. The anodic current can be an alternating current or a direct current. The anodic current can be a pulsed current or a continuous current. If a pulsed anodic current is used, the current can be pulsed between a positive anodic current and zero anodic current, or the current can be pulsed between a positive anodic current to a negative anodic current. Using a negative anodic current can allow some of the metal to re-deposit onto the metal substrate and level out any roughness of the metal substrate. The current density, duration of anodic pulses and overall duration of exposure to anodic current can vary.

After the metal oxide is sufficiently removed and the substrate surface sufficiently activated, at 404 a metal layer is deposited on the activated surface. Depositing the metal layer on the activated surface forms a metallic bond between the metal layer and the metal substrate. In some embodiments, an electrodeposition process is used. In some embodiments, the metal layer is deposited on the activated substrate while in the same ionic liquid used to form the activated surface described at 402. This can avoid potentially exposing the activated surface to an oxidative environment and re-oxidizing the metal substrate surface. In other embodiments, the metal layer is deposited in a different electrodeposition bath. In these embodiments, care can be taken to assure that the activated surface is not re-oxidized. For example, the metal substrate can be transferred from the ionic liquid to the electrodeposition bath while in an inert atmosphere, such as a nitrogen or argon atmosphere. In some embodiments, the electrodeposition bath is substantially free of any oxidizing agent capable of re-oxidizing the metal substrate. Since a metallic bond is formed between the metal layer and the metal substrate, the resultant metal substrate has a cohesive metal coating that can resist peeling and scratching.

Once the metal layer is deposited, at 406 at least a portion of the metal layer is optionally converted to a metal oxide layer. In some embodiments, this is accomplished using an anodizing process. Prior to anodizing, the metal layer can undergo any suitable pre-anodizing process such as cleaning, shaping or texturing processes. Any suitable anodizing process can be used. Since the metal layer is directly bonded to the metal substrate, there is no intermediate layer that could potentially add material to the anodizing bath that is incompatible with the anodizing process.

Figure 5:
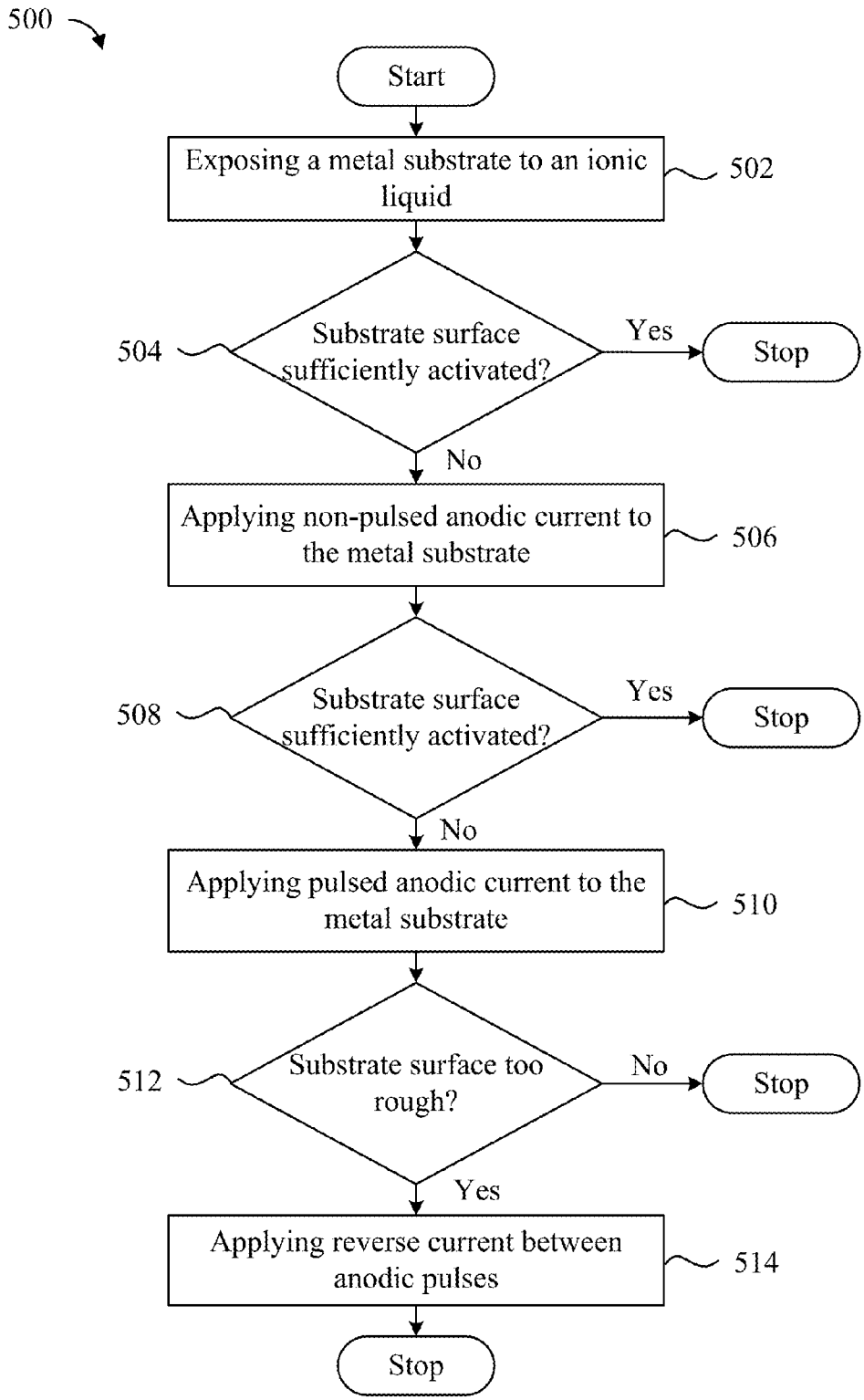
FIG. 5 shows a flowchart indicating a process for determining an appropriate metal substrate activation process in accordance with described embodiments.

FIG. 5 shows flowchart 500 indicating a process for determining an appropriate metal substrate activation process in accordance with described embodiments. At 502, a surface activation process involving exposure of a metal substrate to an ionic liquid is performed. In some embodiments, the ionic liquid is non-aqueous and substantially free of agents capable of re-oxidizing and forming another metal oxide layer on the metal substrate. In some embodiments, the ionic liquid is capable of dissolving any metal oxide layer and/or contaminants on the surface of the metal substrate without applying an electrical current. In other embodiments, an anodic current is needed in order to sufficiently dissolve the metal oxide layer and/or contaminants from the metal substrate. At 504, a determination is made as to whether an activation process using exposure to ionic liquid provides a sufficiently activated surface. In some embodiments, this can be determined empirically after one or more samples are exposed to the ionic liquid immersion followed by an electrodeposition process. The electrodeposited metal layers can be tested for adherence using the methods such as described above with reference to FIGS. 3A-3C. If it is determined that the substrate surface is sufficiently activated (e.g., the deposited metal adhered sufficiently to the substrate surface), a suitable surface activation process has been found.

If is it determined that the substrate surface is not sufficiently activated (e.g., the deposited metal did not sufficiently adhere), at 506 the surface activation process is modified by applying a non-pulsed anodic current to the metal substrate. The non-pulsed anodic current can assist removal of metal oxide and/or contaminants from the surface, thereby assisting activation of the substrate surface. The current density and duration of the applied anodic current can vary depending on a number of factors, including type and size of the metal substrate and type of ionic liquid. At 508, a determination is made as to whether an activation process using non-pulsed anodic current provides a sufficiently activated surface. This can be determined, as described above, by testing one or more samples for adherence after an electrodeposition process. If it is determined that the substrate surface is sufficiently activated (e.g., the deposited metal adhered sufficiently to the substrate surface), a suitable surface activation process has been found.

If is it determined that the substrate surface is not sufficiently activated (e.g., the deposited metal did not sufficiently adhere), at 510 the surface activation process is modified by applying a pulsed anodic current to the metal substrate. Using a pulsed anodic current may allow usage of a larger maximum current compared to using a non-pulsed anodic current, which can further assist removal of the metal oxide and/or contaminants from the metal substrate surface. The current density, duration of each anodic pulse and overall duration of applied anodic current can vary depending on a number of factors, including the type and size of metal substrate and type of ionic liquid. At 512, a determination is made as to whether an activation process using the pulsed anodic current creates substrate surface that is too rough. This can be determined by inspection of the surface of substrate samples after a subsequent electrodeposition process. The roughness quality of the substrate surface can be important in some applications that require a predetermined amount of surface roughness. The roughness can be determined using any suitable technique, including suitable optical measurement techniques. If it is determined that the substrate surface is not too rough, a suitable surface activation process has been found.

If it is determined that the substrate surface is too rough, at 514 the surface activation process is modified by applying a reverse current to the substrate between the anodic current pulses. The reverse current can allow for re-depositing of metal onto the substrate surface between anodic pulses, thereby leveling out some of the roughness on the substrate surface that may have been created during the anodic pulses. The current density and time periods of each of the anodic (forward) and reverse pulses, as well as the overall duration of applied current, can be chosen to achieve a predetermined adhesion and roughness quality of a subsequently deposited metal. Once optimized, a suitable surface activation process has been found.

Note that in some embodiments, a single surface activation process can include a combination of different activation techniques. For example, the metal substrate can be exposed to an ionic liquid without current (502) for a first period of time, followed by applying a pulsed anodic current (510) for a second period of time, followed by applying a reverse current between anodic pulses (514) for a third period of time. That is, any suitable combination of activation techniques 502, 506, 510 and 514 can be used in a single surface activation process in order to achieve a desired result.

Figure 6:
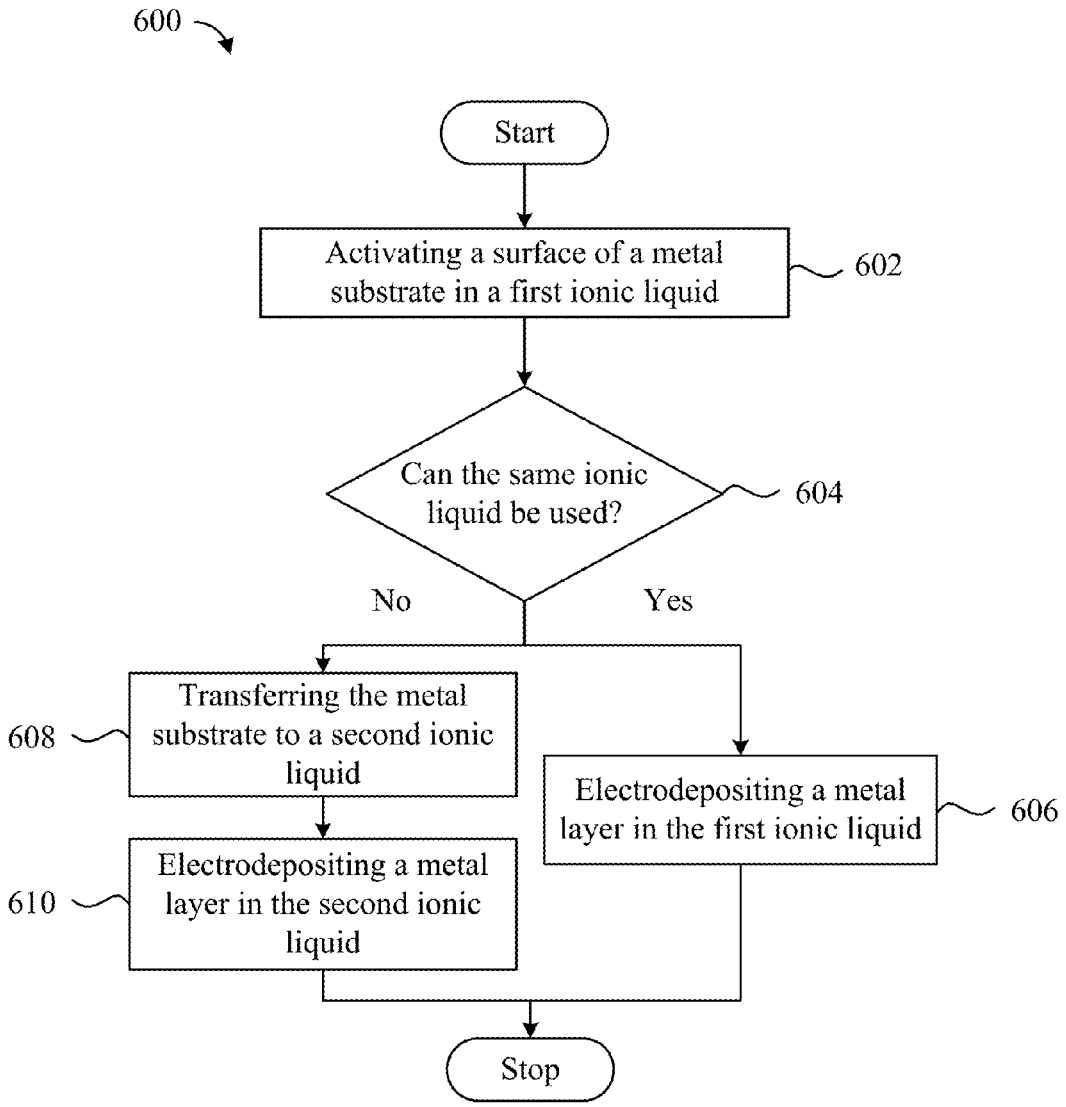
FIG. 6 shows a flowchart indicating a process for determining an appropriate ionic liquid electrodeposition process after surface activation in accordance with described embodiments.

FIG. 6 shows flowchart 600 indicating a process for determining an appropriate ionic liquid electrodeposition process after surface activation. At 602, a surface of a metal substrate is activated in a first ionic liquid using a suitable surface activation method, as described above. At 604, a determination is made as to whether the same ionic liquid used to form the activated surface can be used in a subsequent electrodeposition process. In many instances, it can be beneficial to keep the substrate in the same ionic liquid during surface activation and electrodeposition in order to reduce the risk of re-oxidizing the activated surface. In addition, keeping the substrate in the same ionic liquid simplifies the activation and deposition processes. However, in some cases it can be more beneficial to use different ionic liquids. For example, the ionic liquid used to form the activated surface can have a customized chemical composition to provide optimized surface activation performance but that is not optimized for electrodeposition. In addition, because metal oxide, contaminants and/or substrate metal gets dissolved in the first ionic liquid used for activating the substrate surface, in some cases these materials can inhibit the electrodeposition process. Some other considerations when making the determination can include the chemical composition of the ionic liquid, the type of metal substrate and the amount of metal oxide material, contaminants and/or substrate metal dissolved into the ionic liquid during surface activation.

If it is determined that the same ionic liquid can be used for electrodeposition, at 606 a metal layer is electrodeposited in the first ionic liquid. If it is determined that the same ionic liquid cannot be used for electrodeposition, at 608 the metal substrate is transferred to a second ionic liquid. The transfer should be done in a manner that does not allow the activated substrate surface to be re-oxidized. This can be accomplished by keeping the substrate surface within an inert environment during the transfer. For example, the substrate can be handled in a nitrogen or argon environment between exposure to the first ionic liquid and the second ionic liquid. At 610, a metal layer is deposited on the activated substrate surface in the second ionic liquid. As described above, the second ionic liquid can be customized for optimal electroplating performance. In some cases, the second ionic liquid is a non-aqueous ionic liquid in order to prevent re-oxidizing the activated surface when exposed to the second ionic liquid. In some cases, an electrical current is applied to the substrate prior to exposure to the second ionic liquid. This "going in live" technique can be used if the second ionic liquid is an aqueous ionic liquid to start the deposition process prior to any oxidizing can occur.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A method of depositing an aluminum metal layer on a surface of an aluminum alloy substrate having an aluminum oxide layer, the method comprising:

while the aluminum alloy substrate is immersed in an ionic liquid:

activating the surface of the aluminum alloy substrate by removing a portion of the aluminum oxide layer by:

(i) applying only a positive current to the aluminum alloy substrate, and (ii) applying a series of current pulses including an anodic pulse and a reverse pulse to the aluminum alloy substrate; and forming the aluminum metal layer by electro-depositing aluminum metal on the activated surface of the aluminum alloy substrate.

2. The method of claim 1, wherein the reverse pulse includes using a current density ranging between about −50 mA/cm$^2$ and about −400 mA/cm$^2$, and the anodic pulse includes using a current density ranging between about 50 mA/cm$^2$ and about 400 mA/cm$^2$.

3. The method of claim 2, wherein the reverse pulse is applied for at least the same time period as the anodic pulse.

4. The method of claim 1, wherein the aluminum metal layer is an aluminum alloy layer composed of greater than 50 percent by weight of aluminum.

5. The method of claim 1, wherein the ionic liquid includes a manganese compound such that manganese is co-deposited with aluminum to form an aluminum alloy layer.

6. The method of claim 1, wherein the anodic pulse includes using a current density of about −240 mA/cm$^2$, and the reverse pulse includes using a current density of about 120 mA/cm$^2$.

7. The method of claim 6, wherein a current density amplitude of the anodic pulse is greater than a current density amplitude of the reverse pulse.

8. The method of claim 1, wherein a duration of each of the anodic and reverse pulses ranges between about 5 milliseconds and about 50 milliseconds.

9. The method of claim 1, wherein the aluminum metal layer is substantially free of copper, the method further comprising converting at least a portion of the aluminum metal layer to an oxide layer in an anodizing solution that is substantially free of copper.

10. The method of claim 1, wherein the series of current pulses is applied metal over a period of time of around 5 minutes.

11. The method of claim 1, further comprising anodizing the aluminum metal layer.

12. The method of claim 1, wherein the aluminum metal layer has a thickness ranging between about one micrometer and about 50 micrometers.

13. A method of depositing an aluminum alloy layer on a surface of an aluminum alloy substrate, the method comprising:

activating the surface of the aluminum alloy substrate by immersing the aluminum alloy substrate within an ionic liquid configured to remove at least a portion of a metal oxide layer formed on the aluminum alloy substrate, wherein the activating includes: applying only a positive current to the aluminum alloy substrate, and applying an anodic pulse and a reverse pulse to the aluminum alloy substrate, wherein a current density amplitude of the anodic pulse is greater than a current density amplitude of the reverse pulse; and depositing the aluminum alloy layer on the activated surface using an electrodeposition process while the aluminum alloy substrate is immersed within the ionic liquid.

14. The method of claim 13, wherein the reverse pulse includes using a current density ranging between about −50 mA/cm$^2$ and about −400 mA/cm$^2$, and the anodic pulse includes using a current density ranging between about 50 mA/cm$^2$ and about 400 mA/cm$^2$.

15. The method of claim 13, further comprising converting at least a portion of the aluminum alloy layer to an aluminum oxide using an anodizing solution, wherein the anodizing solution is substantially free of copper.

16. The method of claim 13, wherein the ionic liquid includes an alloy metal that is co-deposited with aluminum to form the aluminum alloy layer.

17. The method of claim 16, wherein the alloy metal is manganese.

* * * * *